US007762646B2

(12) United States Patent
Sakurai

(10) Patent No.: US 7,762,646 B2
(45) Date of Patent: Jul. 27, 2010

(54) HEAD SUBSTRATE, PRINTHEAD, HEAD CARTRIDGE, AND PRINTING APPARATUS USING THE PRINTHEAD OR HEAD CARTRIDGE

(75) Inventor: Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 268 days.

(21) Appl. No.: 12/127,267

(22) Filed: May 27, 2008

(65) Prior Publication Data

US 2008/0231663 A1 Sep. 25, 2008

Related U.S. Application Data

(63) Continuation of application No. 11/274,142, filed on Nov. 16, 2005, now Pat. No. 7,452,050.

(30) Foreign Application Priority Data

Nov. 24, 2004 (JP) ..... 2004-339443

(51) Int. Cl.
*B41J 29/38* (2006.01)
*B41J 29/393* (2006.01)

(52) U.S. Cl. ..... 347/19; 347/9; 347/12

(58) Field of Classification Search ..... 347/9, 347/12, 19

See application file for complete search history.

(56) References Cited

U.S. PATENT DOCUMENTS 6,116,717 A 9/2000 Anderson et al.
6,582,045 B2 6/2003 Hirayama

FOREIGN PATENT DOCUMENTS

JP 5-238038 A 9/1993
JP 2003-11373 A 1/2003

*Primary Examiner*—Julian D Huffman
(74) *Attorney, Agent, or Firm*—Fitzpatrick, Cella, Harper & Scinto

(57) ABSTRACT

Disclosed are a head substrate, a printhead, a head cartridge, and a printing apparatus using the printhead or head cartridge which are capable of separately measuring variations in the resistance of a printing element and variations in the parasitic resistance including the wiring resistance and the ON resistance of a driving element. For example, a head substrate having a plurality of printing elements and a plurality of driving elements for driving the plurality of printing elements includes the first terminal which receives a test signal to the plurality of printing elements, the second terminal which receives a selection signal for selecting and driving at least some of the plurality of printing elements, and the third and fourth terminals which output potentials at the two ends of each of the printing elements selected by the selection signal.

2 Claims, 10 Drawing Sheets

HEAD SUBSTRATE, PRINTHEAD, HEAD CARTRIDGE, AND PRINTING APPARATUS USING THE PRINTHEAD OR HEAD CARTRIDGE

This application is a continuation of U.S. patent application Ser. No. 11/274,142, filed Nov. 16, 2005, the entire disclosure of which is incorporated herein by reference.

FIELD OF THE INVENTION

This invention relates to a head substrate, a printhead, a head cartridge, and a printing apparatus using the printhead or head cartridge, and particularly to a head substrate formed by, on the same substrate, an electrothermal transducer for generating thermal energy necessary to discharge ink and a driving circuit for driving the electrothermal transducer, a printhead using the head substrate, a head cartridge using the printhead, and a printing apparatus using the printhead or head cartridge.

BACKGROUND OF THE INVENTION

A thermal inkjet method has conventionally been known as an information output apparatus used for a word-processor, personal computer, facsimile apparatus, and the like.

Especially according to a thermal inkjet method, many nozzles can be formed on a printhead at high density.

Also, such a thermal inkjet type printhead (to be referred to as a printhead hereinafter) adopts a printing element (to be referred to as a heater board hereinafter) in which a heater for heating ink, a protective film for the heater, a driver circuit for supplying a current to the heater, a logical circuit for controlling the driver circuit, and the like are integrated into a single-crystal silicon substrate by a semiconductor integrated circuit manufacturing process.

FIG. 9 is a circuit diagram showing the circuit configuration of a heater and its driving circuit inside a conventionally known heater board.

In FIG. 9, reference numeral 101 denotes each heater for heating ink; 102, each driver transistor serving as a switch for supplying a current to the heater; 103 and 104, wiring resistances which are parasitic in wiring lines for connecting the heater 101 and driver transistor 102 to pads for electrical connection to the outside of the printhead; and 105 and 106, pad terminals VH (positive potential) and GNDH (reference potential) for externally applying power, respectively.

As is apparent from FIG. 9, the heater 101 and driver transistor 102 are in one-to-one correspondence. By selecting and driving any desired driver transistor, supply of a current to a corresponding heater can be controlled. At this time, the driver transistor is selected and driven by supplying an element selection output from the internal circuit (not shown) of the heater board to a gate terminal 107 of the driver transistor.

As shown in FIG. 9, an electrical connection from the pad to the heater and driver transistor is achieved by an independent wiring line for a group of adjacent heaters and driver transistors. With this wiring, variations in resistance value depending on the distance between each heater, each driver transistor, and the pad fall within a predetermined range. In addition, a voltage drop by the wiring resistance is kept constant in each group by limiting the number of simultaneously energized heaters in each group to one.

Many heaters formed on the heater board are desired to ideally generate uniform powers by all heaters without any variations. In practice, however, powers vary.

The variations in power are caused by variations in the resistances of wiring lines which connect heaters and pads serving as electric contacts on the heater board, variations in the ON resistances of driver transistors for controlling energization to heaters, variations in the resistance values of heaters, and the like.

Variations in power generated by the heater are directly influenced by variations in not the resistance value of the heater but the wiring resistance and the ON resistance of the driver transistor. That is, as a resistance other than the heater resistance increases, the increased resistance consumes the voltage and current, and power generated by the heater decreases.

Influence by variations in heater resistance is reduced against power variations.

More specifically, when each heater resistance becomes higher than a design center value owing to variations in heater resistance, a voltage applied to the heater rises, but a flowing current decreases. Since generated power is expressed as the product of the voltage and current, the increase in voltage and the decrease in current are canceled. As a result, the influence becomes smaller than the influence of variations in resistance other than the heater resistance.

FIG. 10 is a circuit diagram schematically showing a circuit configuration for supplying a current to one heater.

In FIG. 10, Rh represents the resistance of the heater 101; and Rp, the sum of a wiring resistance other than the heater resistance, and a parasitic resistance 108 such as the ON resistance of the transistor. These resistances are series-connected.

Assume that, as design center values, the heater resistance is Rh=100Ω, the parasitic resistance including the wiring resistance and ON resistance is Rp=50Ω, and the power supply voltage (V) between terminals is V=15 V.

Since the total resistance of the system is 100Ω+50Ω=150Ω and the voltage between terminals is 15 V, the current (I) is $$I=V/R=15\text{ V}/150\Omega=0.1\text{ A}$$

Under these conditions, power generated by the heater is given by $$P=V\times I=R\times I^2=100\Omega\times(0.1\text{ A})^2=1\text{ W}$$

Assuming that the parasitic resistance varies from the center value 50Ω to 60Ω, power generated by the heater changes as follows.

More specifically, since the total resistance of the system is 100Ω+60Ω=160Ω and the voltage between terminals is 15 V, the current (I) is $$I=V/R=15\text{ V}/160\Omega=0.0938\text{ A}$$

Hence, the generated power is $$P=V\times I=R\times I^2=100\Omega\times(0.0938\text{ A})^2=0.880\text{ W}$$

Assuming that the resistance value of the heater varies from the center value 100Ω to 110Ω while the parasitic resistance remains at the center value of 50Ω, power generated by the heater changes as follows.

More specifically, since the total resistance of the system is 110Ω+50Ω=160Ω and the voltage between terminals is 15 V, similar to the above example, the current (I) is $$I=V/R=15\text{ V}/160\Omega=0.0938\text{ A}$$

Hence, power generated by the heater is.

$$P=V\times I=R\times I^2=110\Omega\times(0.0938\text{ A})^2=0.968\text{ W}$$

From the above example, the influence of variations in heater resistance to a larger value is smaller on variations in power than on variations in parasitic resistance. Similarly, the influence of variations in heater resistance to a smaller value is smaller on variations in power than on variations in parasitic resistance.

As described above, the resistance of a heater serving as a printing element formed on a heater board, and parasitic resistances such as the wiring resistance and the ON resistance of a driving transistor vary in resistance value.

Whether or not variations in resistance values fall within the tolerance is determined by electrically measuring the resistance values. The measurement has conventionally been done by measuring the total resistance of the heater resistance and parasitic resistance.

As is apparent from the above description, variations in power generated by the heater change depending on whether the cause of variations in resistance value is the heater resistance or parasitic resistance (see Japanese Patent Publication Laid Open No. 2003-11373).

From the viewpoint of stable operation check of the printhead, necessary information is variations in power generated by the heater. The variations have conventionally been measured by measuring the total resistance of the heater resistance and parasitic resistance. It is, therefore, difficult to identify whether the cause of variations is the heater resistance or parasitic resistance. It is obvious from the above consideration that when the cause of variations is the heater resistance, the tolerance can be made wider than that for the parasitic resistance.

However, the prior art must always prepare for the worst case because it is difficult to identify the cause. The specifications must be defined so that no problem occurs even when all measured variations are caused by the parasitic resistance. If power generated by the heater satisfies the specifications of the product, but the total resistance value of the system does not satisfy the specifications, the heater board is determined as a defective. This decreases the yield.

SUMMARY OF THE INVENTION

Accordingly, the present invention is conceived as a response to the above-described disadvantages of the conventional art.

For example, a head substrate, printhead using the head substrate and head cartridge using the printhead according to the present invention are capable of separately measuring variations in the resistance of a printing element and variations in the parasitic resistance including the wiring resistance and the ON resistance of a driving element.

According to one aspect of the present invention, preferably, there is provided a head substrate having a plurality of printing elements and a plurality of driving elements for driving the plurality of printing elements, comprising: a first terminal, common to the plurality of printing element, which receives a test signal for either one or more of the plurality of printing elements; a second terminal which receives a selection signal for selecting and driving at least some of the plurality of printing elements; and a third terminal which outputs a potential of at least one end of each of the printing elements selected by the selection signal received by the second terminal in response to the test signal received by the first terminal.

The head substrate preferably further comprises a fourth terminal which outputs a potential of the other end of each of the printing elements selected by the selection signal.

The plurality of driving elements preferably include first MOS transistors, and the head substrate preferably further comprises a second MOS transistor for selecting a printing element by the selection signal, and a third MOS transistor for energizing a printing element by the test signal.

In this case, the selection signal is preferably commonly input to a gate of the first MOS transistor and a gate of the second MOS transistor, and the test signal is preferably input to a gate of the third MOS transistor.

The potential of the at least one end is a potential on a side on which the printing element is connected to the first MOS transistor. The potential of the other end is a potential on a side on which the plurality of printing elements are connected to a common power supply, and which is opposite to a side on which the printing element is connected to the first MOS transistor.

The head substrate preferably further comprises a fourth MOS transistor and a fifth MOS transistor which are series-connected between the fourth terminal and the side on which the plurality of printing elements are connected to the common power supply, the selection signal is preferably input to a gate of the fourth MOS transistor, and the test signal is preferably input to the fifth MOS transistor.

According to another aspect of the present invention, preferably, there is provided a printhead comprising: a head substrate having a plurality of printing elements and a plurality of driving elements for driving the plurality of printing elements: a first terminal, common to the plurality of printing element, which receives a test signal for either one or more of the plurality of printing elements; a second terminal which receives a selection signal for selecting and driving at least some of the plurality of printing elements; a third terminal which outputs a potential of at least one end of each of the printing elements selected by the selection signal received by the second terminal in response to the test signal received by the first terminal; and a plurality of orifices, respectively arranged for the plurality of printing elements, for discharging ink.

The printhead preferably further comprises an electrothermal transducer for generating thermal energy to be applied to the ink in order to discharge the ink by using the thermal energy.

According to still another aspect of the present invention, preferably, there is provided a head cartridge comprising: a printhead having the above construction; and an ink tank containing ink to be supplied to the printhead.

According to still another aspect of the present invention, preferably, there is provided a printing apparatus for printing by using a printhead having the above construction.

The invention is particularly advantageous since the voltage of at least one end of a printing element can be output outside the head substrate via a terminal, and, e.g., the resistance component of the printing element and the remaining parasitic resistance component can be separately measured.

The tolerance of variations for conventional measurement of the resistance value can be defined as the tolerance of power variations directly caused by the printing element. The tolerance of variations can therefore be made wider than the conventional one. A head substrate which is defective according to a conventional measurement method may be determined as a non-defective. As a result, an increase in manufacturing yield can be achieved.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

Furthermore, the term "on a substrate" means not only "on an element substrate", but also "the surface of an element substrate" or "inside an element substrate near the surface". The term "built-in" in the present invention does not represent that each separate element is arranged as a separate member on a substrate surface, but represents that each element is integrally formed and manufactured on an element substrate by a semiconductor circuit manufacturing process or the like.

<Description of Inkjet Printing Apparatus (FIG. 1)>

Figure 1:
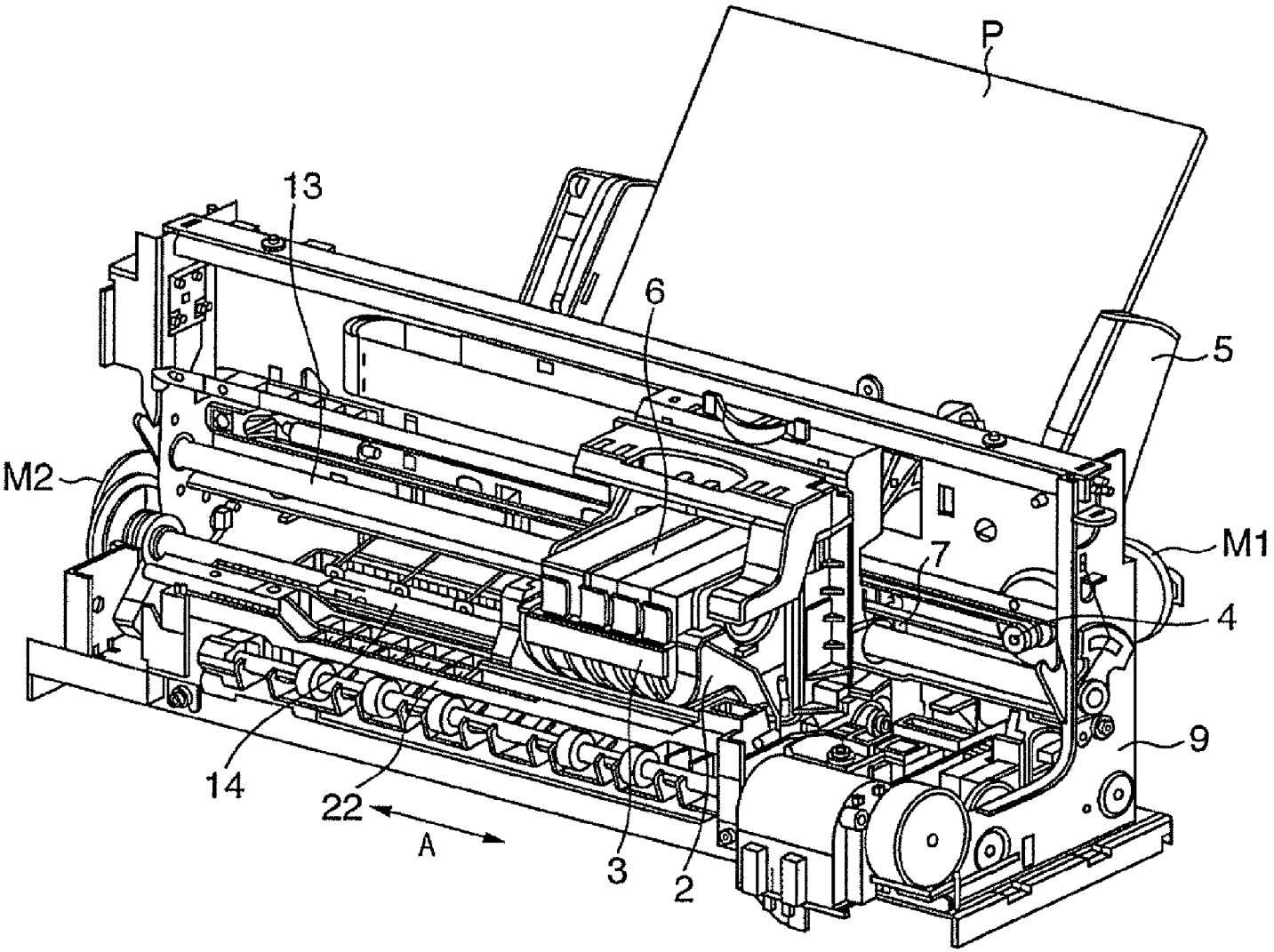
FIG. 1 is a perspective view showing an internal arrangement of an inkjet printing apparatus as a typical embodiment of the present invention.

FIG. 1 is an outer perspective view showing the schematic configuration of an inkjet printing apparatus 1 as a typical embodiment of the present invention.

As shown in FIG. 1, the inkjet printing apparatus (to be referred to as a printing apparatus hereinafter) mounts a printhead 3 which prints by discharging ink according to the inkjet method. A driving force generated by a carriage motor M1 is transmitted from a transmission mechanism 4 to a carriage 2, and the carriage 2 reciprocates in a direction indicated by an arrow A. In printing, a printing medium P such as a printing sheet is fed via a sheet feed mechanism 5, and conveyed to a printing position. At the printing position, the printhead 3 discharges ink to the printing medium P to print.

In order to maintain a good state of the printhead 3, the carriage 2 is moved to the position of a recovery device 10, and a discharge recovery process for the printhead 3 is executed intermittently.

The carriage 2 of the printing apparatus 1 mounts not only the printhead 3, but also an ink cartridge 6 which stores ink to be supplied to the printhead 3. The ink cartridge 6 is detachable from the carriage 2.

The printing apparatus 1 shown in FIG. 1 can print in color. For this purpose, the carriage 2 mounts four ink cartridges which respectively store magenta (M), cyan (C), yellow (Y), and black (K) inks. The four ink cartridges are independently detachable.

The carriage 2 and printhead 3 can achieve and maintain a desirable electrical connection by properly bringing their contact surfaces into contact with each other. The printhead 3 selectively discharges ink from a plurality of orifices and prints by applying energy in accordance with the printing signal. In particular, the printhead 3 according to this embodiment employs an inkjet method of discharging ink by using thermal energy. According to this inkjet method, the printhead 3 discharges ink from corresponding orifices by applying a pulse voltage to a corresponding electrothermal transducer in accordance with the printing signal.

In FIG. 1, reference numeral 14 denotes a conveyance roller which is driven by a conveyance motor M2 in order to convey the printing medium P.

In the above example, the printhead and the ink cartridge which stores ink are separable from each other. However, a head cartridge formed by integrating the printhead and ink cartridge may be mounted on the carriage 2, which will be described later.

Figure 2:
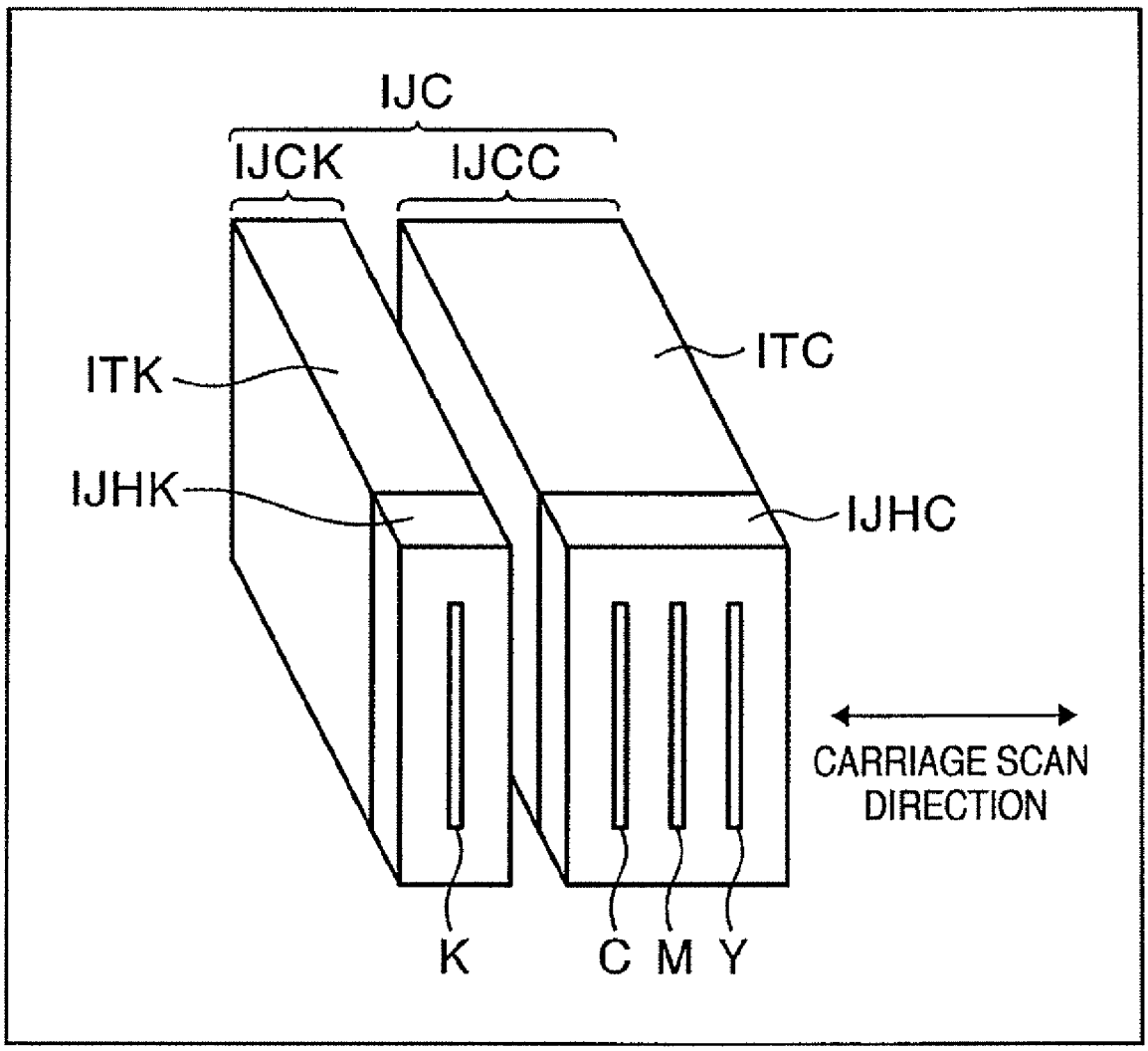
FIG. 2 is an outer perspective view showing an example of the structure of a head cartridge.

FIG. 2 is an outer perspective view showing an example of the structure of the head cartridge.

As shown in FIG. 2, an inkjet cartridge IJC is made up of a cartridge IJCK which discharges black ink, and a cartridge IJCC which discharges three, cyan (C), magenta (M), and yellow (Y) color inks. These two cartridges are separable from each other and independently detached from the carriage 2.

The cartridge IJCK is made up of an ink tank ITK which stores black ink, and a printhead IJHK which prints by discharging black ink. The ink tank ITK and printhead IJHK are integrated. Similarly, the cartridge IJCC is made up of an ink tank ITC which stores the three, cyan (C), magenta (M), and yellow (Y) color inks, and a printhead IJHC which prints by discharging these color inks. The ink tank ITC and printhead IJHC are also integrated. Note that the embodiment exemplifies the cartridge in which ink is filled in the ink tank.

As is apparent from FIG. 2, a nozzle array which discharges black ink, a nozzle array which discharges cyan ink, a nozzle array which discharges magenta ink, and a nozzle array which discharges yellow ink are aligned in the carriage moving direction. To the contrary, the nozzle array direction intersects the carriage moving direction.

<Control Configuration of Inkjet Printing Apparatus (FIG. 3)>

Figure 3:
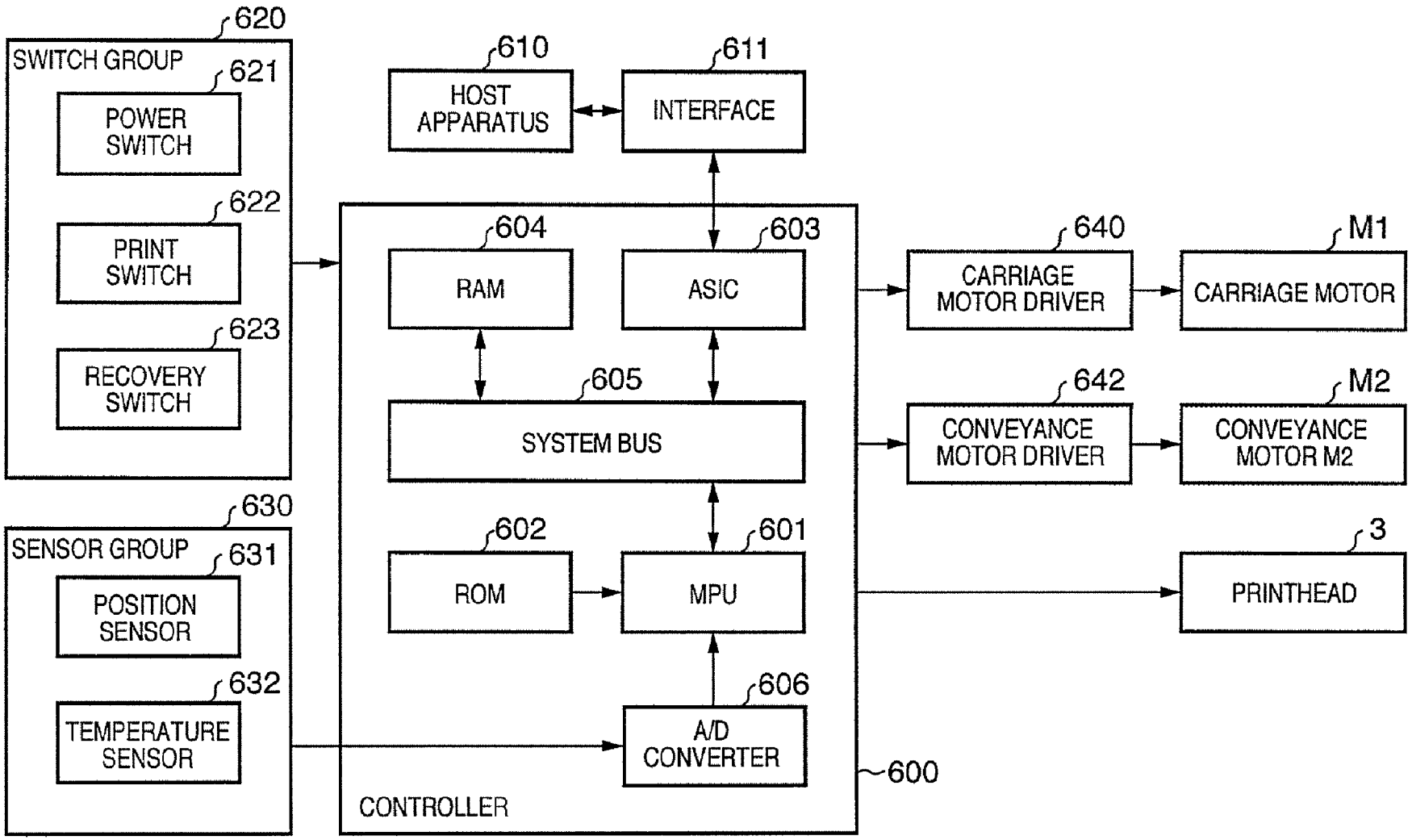
FIG. 3 is a block diagram showing the control configuration of the printing apparatus shown in FIG. 1.

FIG. 3 is a block diagram showing the control configuration of the printing apparatus shown in FIG. 1.

As shown in FIG. 3, a controller 600 comprises an MPU 601, ROM 602, ASIC (Application Specific Integrated Circuit) 603, RAM 604, system bus 605, and A/D converter 606. The ROM 602 stores a program corresponding to a control sequence (to be described later), a predetermined table, and other fixed data. The ASIC 603 generates control signals for controlling the carriage motor M1, conveyance motor M2, and printhead 3. The RAM 604 is used as an image data rasterizing area, a work area for executing a program, and the like. The system bus 605 connects the MPU 601, ASIC 603, and RAM 604 to each other, and allows exchanging data. The A/D converter 606 receives analog signals from a sensor group (to be described below), A/D-converts the analog signals, and supplies digital signals to the MPU 601.

In FIG. 3, reference numeral 610 denotes a computer (or an image reader, digital camera, or the like) which serves as an image data supply source and is generally called a host apparatus. The host apparatus 610 and printing apparatus 1 transmit/receive image data, commands, status signals, and the like via an interface (I/F) 611.

Reference numeral 620 denotes a switch group which is formed from a power switch 621, print switch 622, recovery switch 623, and the like. The print switch 622 is used for designating the start of printing. The recovery switch 623 is used for designating the activation of a process (recovery process) of maintaining good ink discharge performance of the printhead 3. These switches are formed from switch assemblies for receiving instruction inputs from the operator.

Reference numeral 630 denotes a sensor group which detects the state of the apparatus. The sensor group includes a position sensor 631 such as a photocoupler for detecting a home position h and a temperature sensor 632 arranged at a proper portion of the printing apparatus in order to detect the ambient temperature.

Reference numeral 640 denotes a carriage motor driver which drives the carriage motor M1 for reciprocating the carriage 2 in the direction indicated by the arrow A; and 642, a conveyance motor driver which drives the conveyance motor M2 for conveying the printing medium P.

In printing and scanning by the printhead 3, the ASIC 603 transfers driving data (DATA) for a printing element (heater) to the printhead while directly accessing the storage area of the RAM 604.

Several embodiments of a head substrate used for the printhead of the printing apparatus having the above configuration will be explained. In particular, the configuration of a driving circuit built in a head substrate (heater board) will be mainly described.

Note that members (not shown) for forming an ink orifice and a channel which communicates with the ink orifice are formed in correspondence with each printing element on the substrate, thereby constructing the printhead.

Ink supplied onto the printing element is heated by driving the printing element, and bubbles are created by film boiling to discharge ink from the orifice.

First Embodiment

Figure 4:
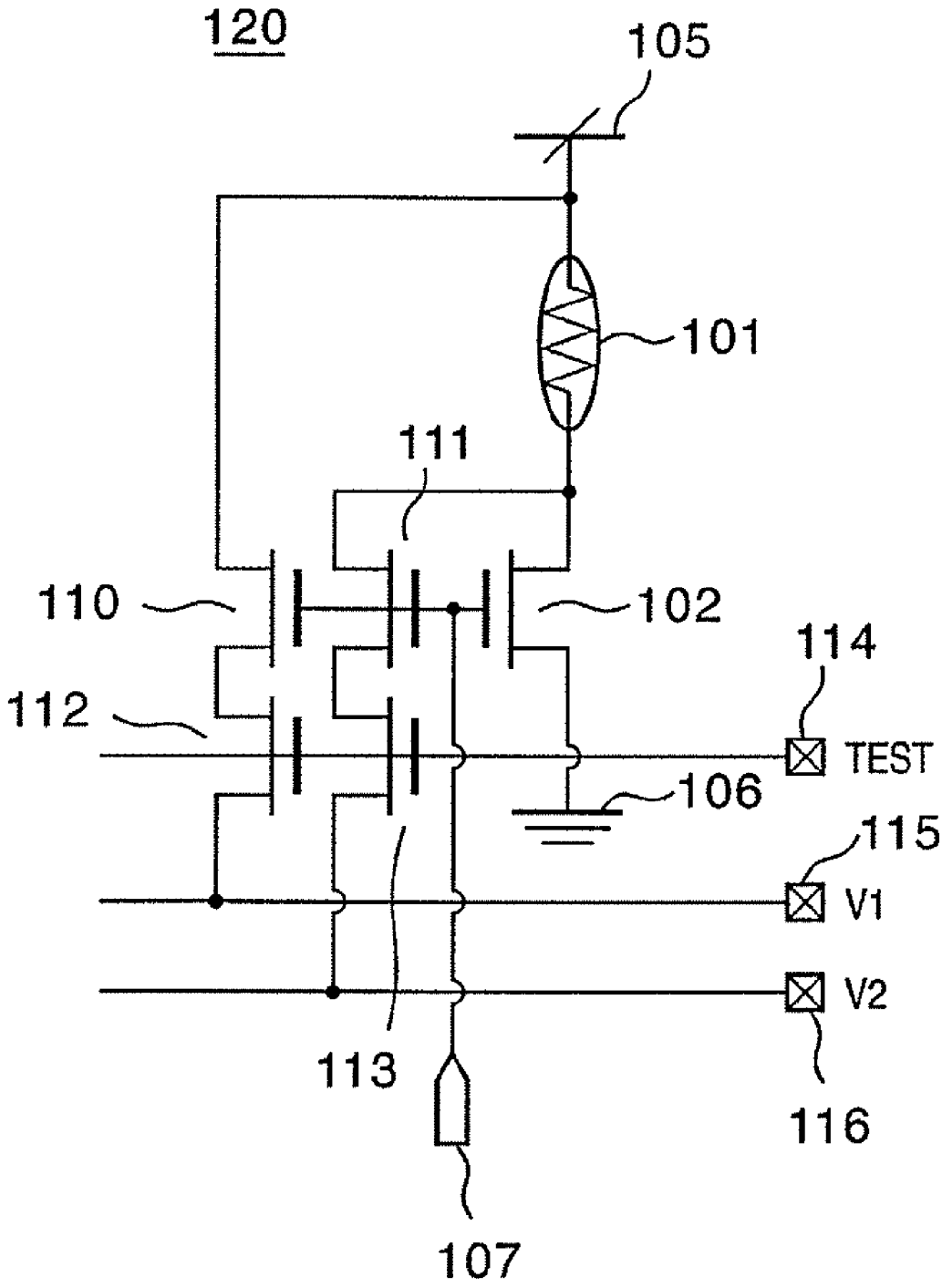
FIG. 4 is a circuit diagram showing the configuration of a 1-bit circuit in a peripheral heater circuit according to the first embodiment of the present invention.

FIG. 4 is a circuit diagram showing the configuration of a 1-bit circuit 120 in a peripheral heater circuit according to the first embodiment of the present invention. In FIG. 4, the same reference numerals as in the prior art denote the same parts, and a description thereof will be omitted.

As shown in FIG. 4, the nodes of a heater 101 at two ends are connected to monitor output terminals 115 and 116 via bit select switches 110 and 111 each formed from a MOS transistor, and test select switches 112 and 113 each formed from a MOS transistor.

In the first embodiment, the bit select switch 110 serves as the (+) side, and the bit select switch 111 serves as the (−) side. The test select switch 112 serves as the (+) side, and the test select switch 113 serves as the (−) side. The monitor output terminal 115 serves as the (+) side, and the monitor output terminal 116 serves as the (−) side.

Note that the MOS transistors 110-113 function as switches for monitoring potentials. Compared to the MOS transistors 102, very few currents flow through these transistors. Thus, the sizes of the MOS transistors 110-113 are approximately one several tenth of that of the MOS transistors 102. Therefore, even though such a circuit is provided to each heater, the circuit size does not increase so significantly.

As is apparent from FIG. 4, a gate terminal 107 of the bit select switches 110 and 111 receives an element selection output from an internal circuit. The gates of the test select switches 112 and 113 receive an externally supplied logical signal (TEST) via a test select terminal 114. The signal supplied to the gates of the test select switches 112 and 113 may be a signal which is directly supplied from the test select terminal 114, or a signal which has undergone any logical operation.

Figure 5:
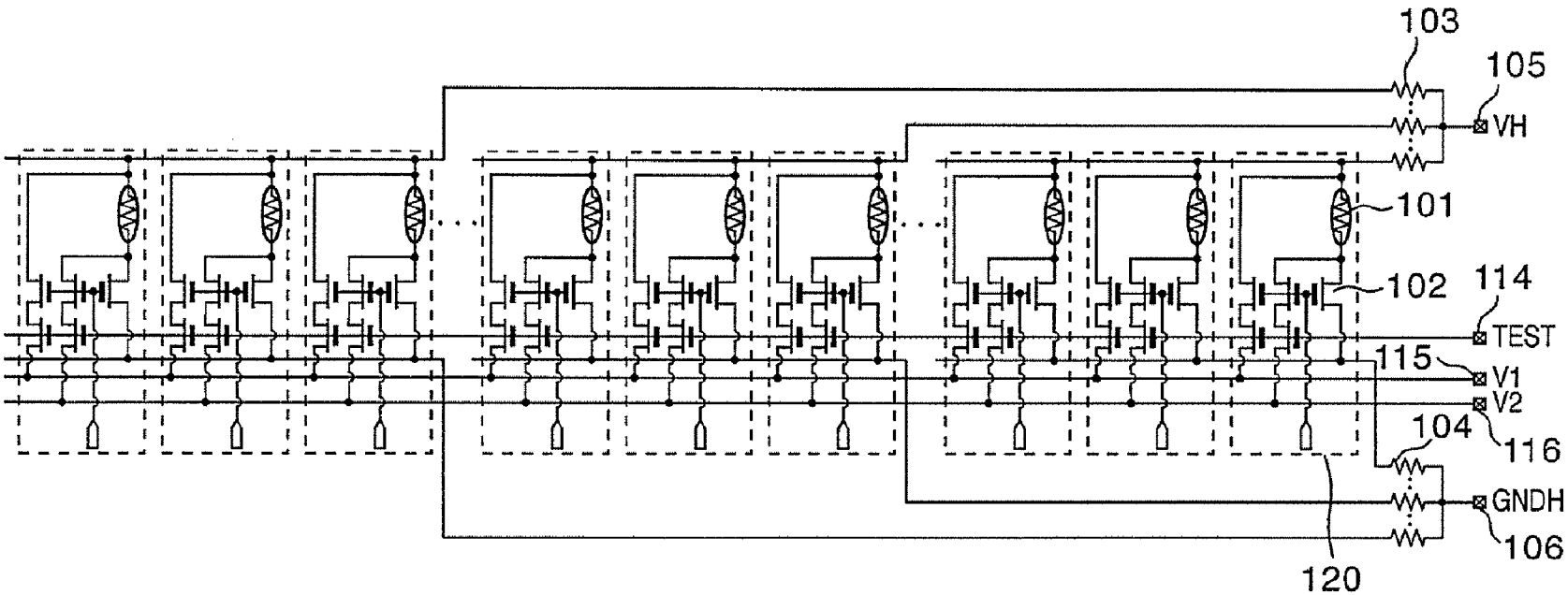
FIG. 5 is a circuit diagram showing the configuration of the peripheral heater circuit according to the first embodiment of the present invention.

FIG. 5 is a circuit diagram showing the configuration of a peripheral heater circuit in which a plurality of 1-bit circuits 120 shown in FIG. 4 are aligned. Also in FIG. 5, the same reference numerals as in the prior art denote the same parts, and a description thereof will be omitted.

In FIG. 5, the 1-bit circuit 120 shown in FIG. 4 is surrounded by a broken line, and a plurality of 1-bit circuits are arranged.

As is apparent from FIG. 5, the two nodes of a heater contained in each of the 1-bit circuits 120 are connected to the monitor output terminals 115 and 116 via the bit select switches 110 and 111 and the test select switches 112 and 113 shown in FIG. 4.

The gates of the bit select switches 110 and 111 receive an element selection output from the internal circuit of each 1-bit circuit.

The test select terminal 114 is commonly connected to the gates of the test select switches 112 and 113 of the respective 1-bit circuits 120.

Operation of the circuit having the above configuration will be explained with reference to a flowchart.

Figure 6:
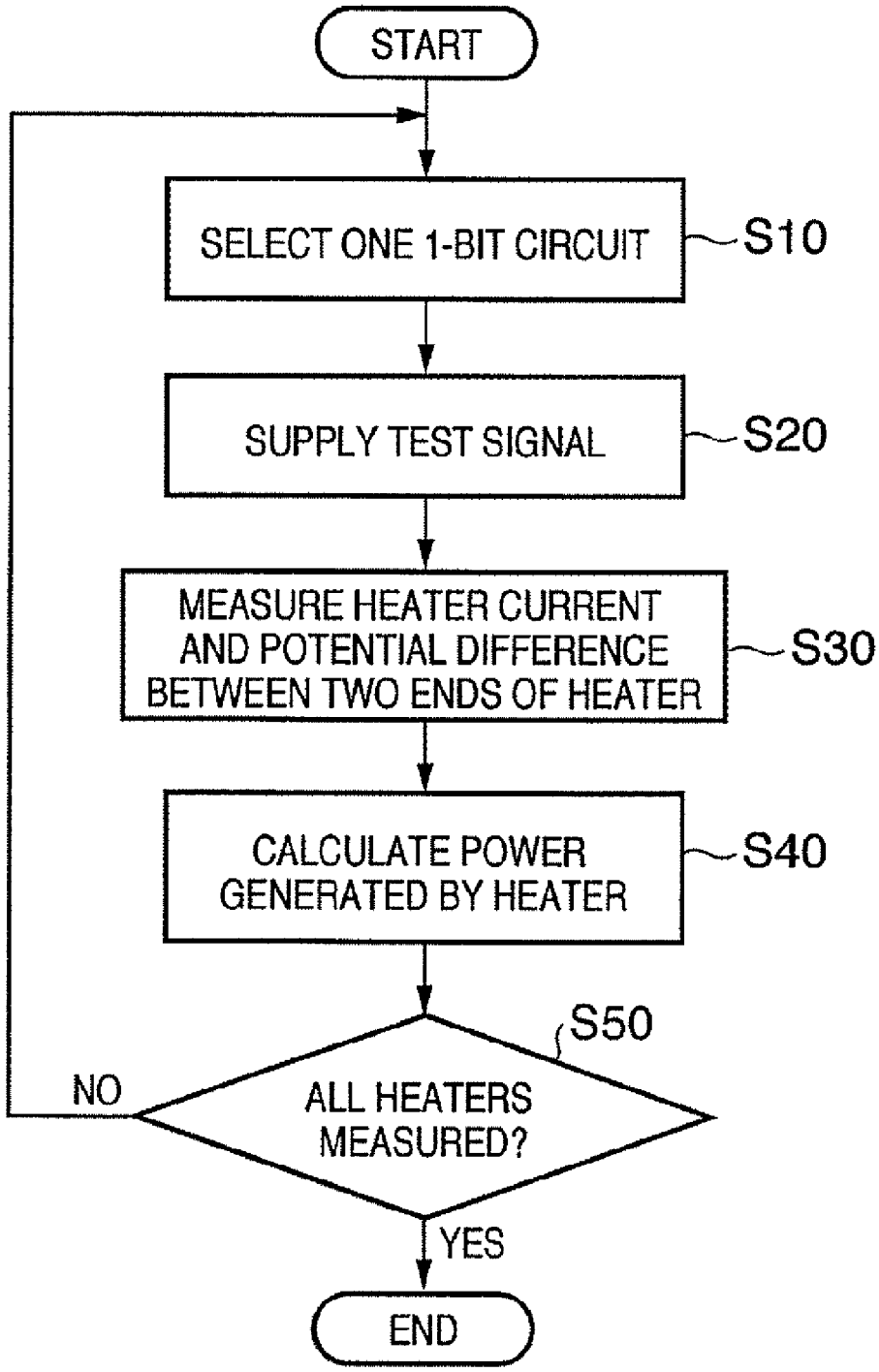
FIG. 6 is a flowchart showing a resistance measurement sequence.

FIG. 6 is a flowchart showing a resistance measurement sequence according to the first embodiment.

In step S10, an arbitrary 1-bit circuit 120 for measuring power generated by a heater is selected by an element selection output from the internal circuit via the gate terminal 107.

In step S20, a logical signal (TEST) for turning on the test select switches 112 and 113 is supplied to the test select terminal 114.

At this time, all the test select switches are ON at all bits. However, only one arbitrarily selected bit select switch is ON, and potentials (V1 and V2) at the two ends of a heater corresponding to the selected bit are output to the monitor output terminals 115 and 116.

In step S30, a current is supplied to the heater, and the current value (I) and the voltage expressed by the difference value (V1-V2) across the heater are measured.

In step S40, power generated by the heater is obtained from the values measured in step S30.

In step S50, it is determined whether or not all printing elements (heaters) have been measured. If it is determined that the measurement is not completed, the process returns to step S10. An element selection output is input to the gate terminal 107 of the next 1-bit circuit 120, a measurement target is selected, and the above process is repeated. If it is determined that the measurement has been completed, the process ends.

In this way, the measurement is sequentially done for all bits, and not only variations in the resistance including the wiring resistance and the ON resistance of the transistor in the prior art and also variations in power generated by the heater can be obtained. As a result, the tolerance of variations can be made wider than the conventional one, and a higher yield can be achieved.

Second Embodiment

Figure 7:
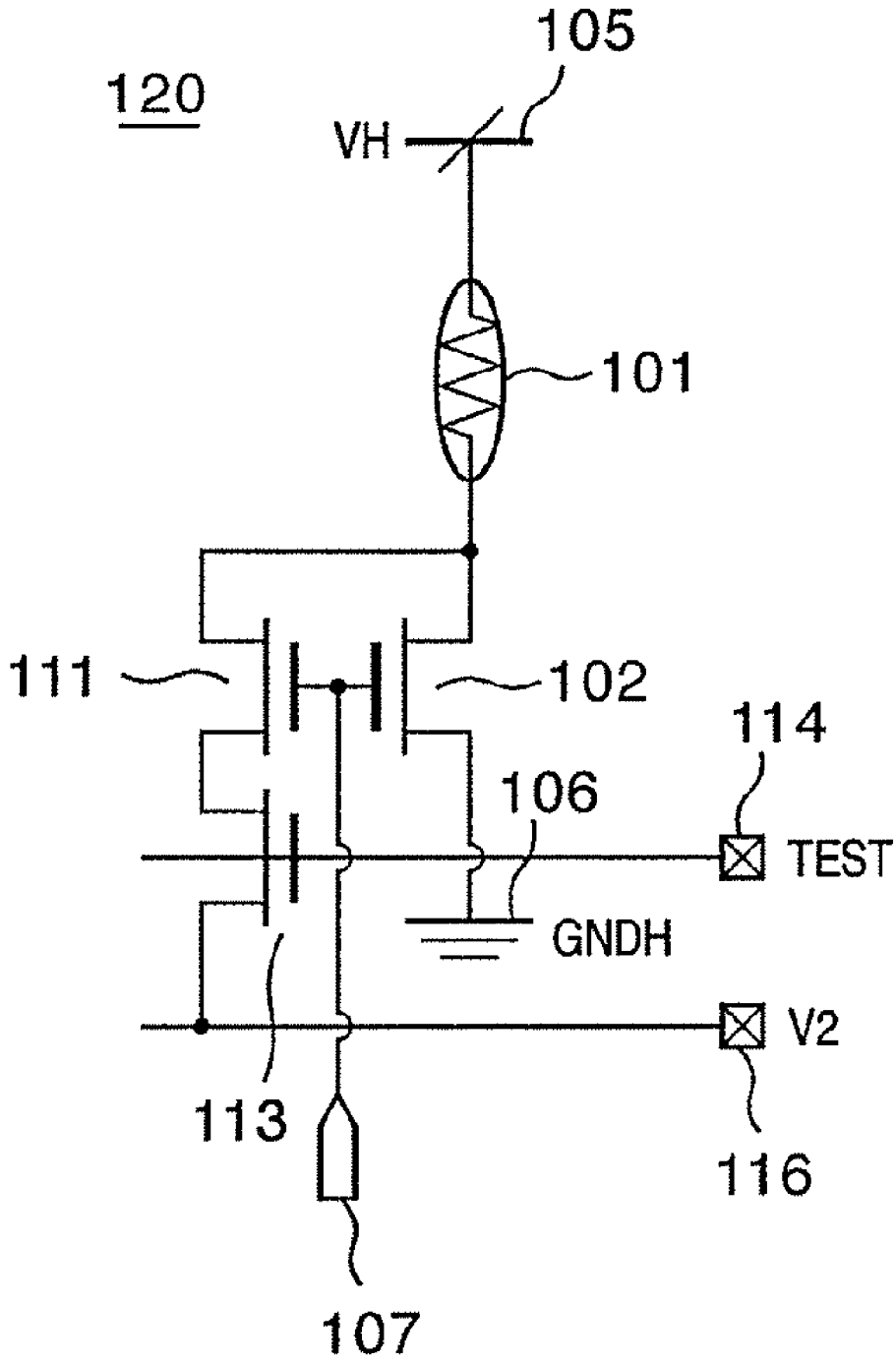
FIG. 7 is a circuit diagram showing the configuration of a 1-bit circuit in a peripheral heater circuit according to the second embodiment of the present invention.

FIG. 7 is a circuit diagram showing the configuration of a 1-bit circuit 120 in a peripheral heater circuit according to the second embodiment of the present invention. In FIG. 7, the same reference numerals as in the prior art and the first embodiment denote the same parts, and a description thereof will be omitted.

The feature of the second embodiment is to simplify the configuration of the peripheral heater circuit by outputting only a potential at one terminal, while the configuration of the first embodiment in which potentials at the two terminals of the heater can be output to the monitor terminal.

More specifically, in the configuration shown in FIG. 7, a node of a heater 101 on the side of a driver transistor 102 is connected to a monitor output terminal 116 via a bit select switch 111 and test select switch 113. The gate of the bit select switch 111 receives an element selection output from an internal circuit via a gate terminal 107. The gate of the test select switch 113 receives an externally supplied logical signal (TEST) via a test select terminal 114. The signal supplied to the gate of the test select switch 113 may be a signal which is directly supplied from the test select terminal 114, or a signal which has undergone any logical operation. This is the same as in the first embodiment.

Figure 8:
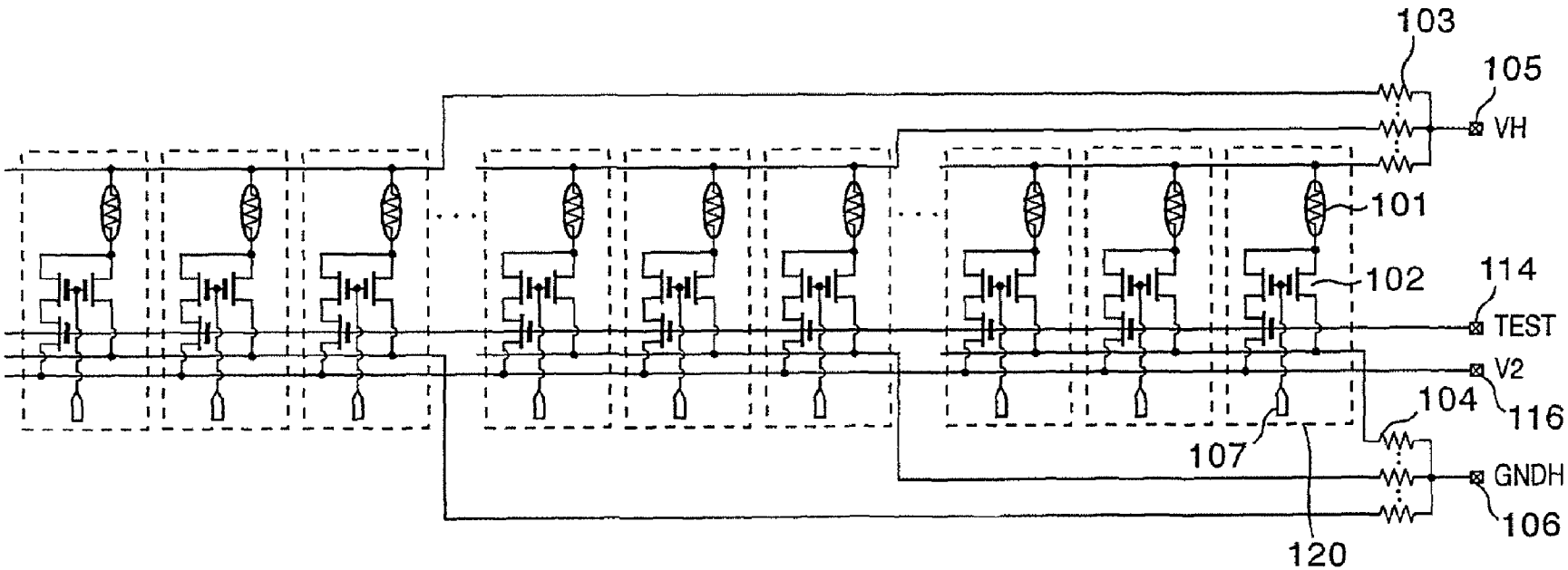
FIG. 8 is a circuit diagram showing the configuration of the peripheral heater circuit according to the second embodiment of the present invention.
Figure 9:
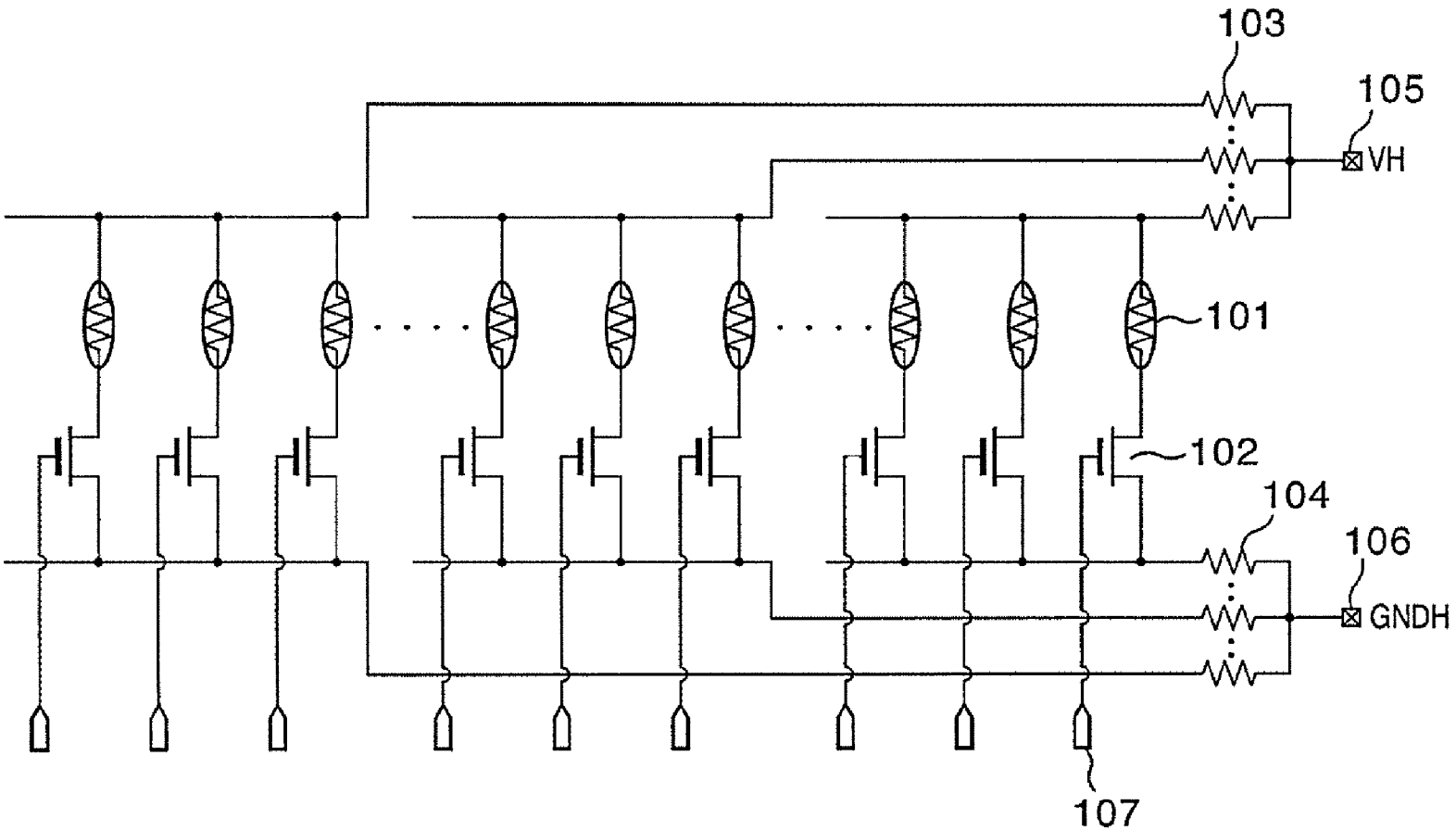
FIG. 9 is a circuit diagram showing the circuit configuration of a heater and its driving circuit inside a conventionally known heater board.
Figure 10:
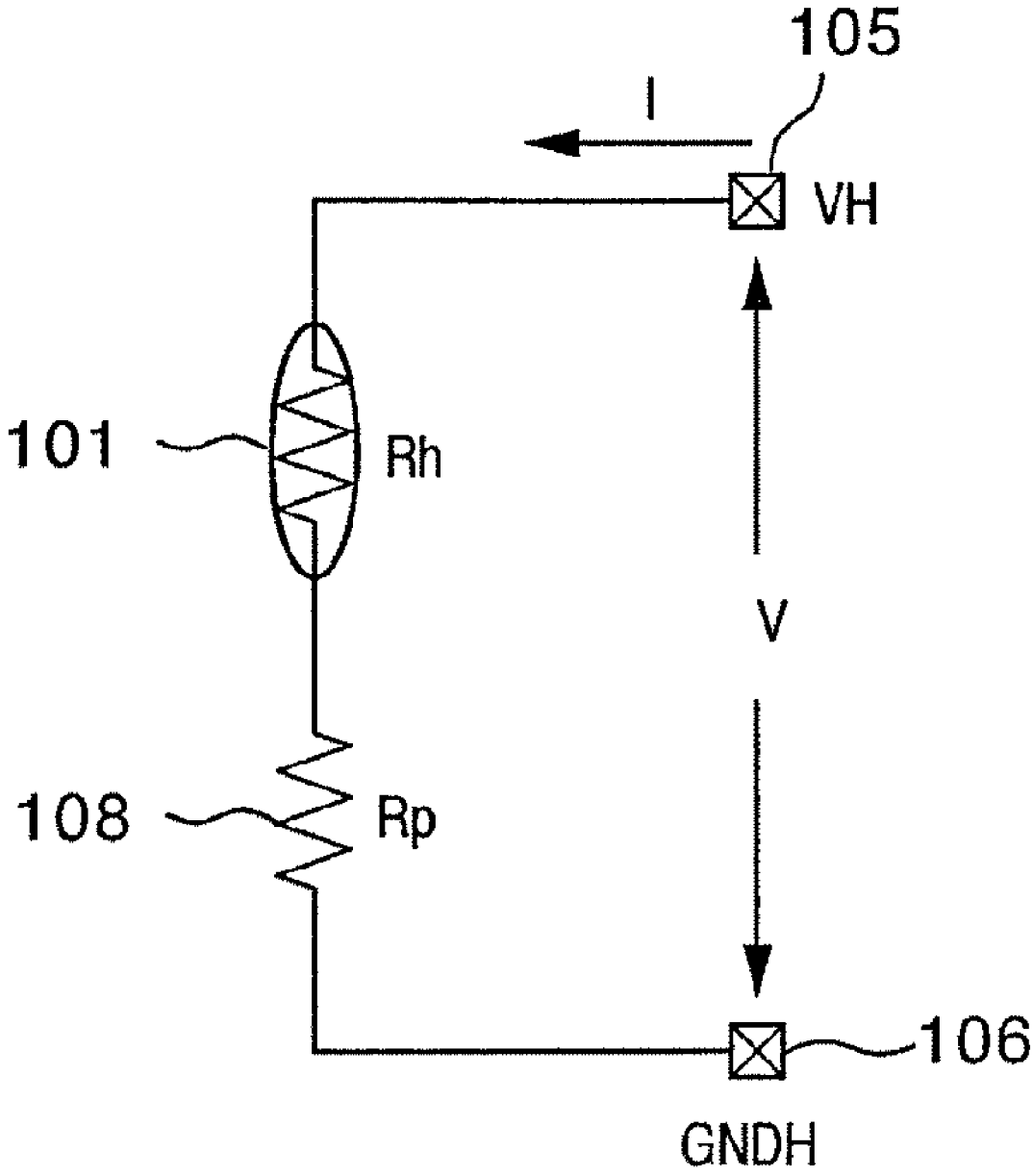
FIG. 10 is a circuit diagram schematically showing a circuit configuration for supplying a current to one heater.

FIG. 8 is a circuit diagram showing the configuration of a peripheral heater circuit in which a plurality of 1-bit circuits 120 shown in FIG. 7 are aligned. Also in FIG. 8, the same reference numerals as in the prior art and the first embodiment denote the same parts, and a description thereof will be omitted.

In FIG. 8, the 1-bit circuit 120 shown in FIG. 7 is surrounded by a broken line, and a plurality of 1-bit circuits are arranged.

In the configuration shown in FIG. 8, a node, on the side of the driver transistor 102, of the heater 101 contained in each of the 1-bit circuits 120 is connected to the monitor output terminal 116 via the bit select switch 111 and test select switch 113. The gate of the bit select switch 111 receives an element selection output via the gate terminal 107, similar to the first embodiment. The test select terminal 114 is commonly connected to the gates of the test select switches 113 of the respective 1-bit circuits 120.

Operation of the circuit having the above configuration will be explained.

Also in the second embodiment, similar to the first embodiment, the test select switch is turned on, and an arbitrary bit select switch is turned on. Then, a potential at a node of the heater on the driver transistor side is output to the monitor output terminal 116. The subsequent sequence is the same as that in the first embodiment.

The second embodiment is applicable to a case where a parasitic resistance 103 present on a power supply terminal (VH) 105 is much smaller than the resistance value of the heater 101 and the sum of the ON resistance of the driver transistor and a parasitic resistance 104 present on a power supply terminal (GNDH) 106, and no problem occurs in measurement of power generated by the heater 101. In this case, the layout area of the heater board can be suppressed.

The reason of outputting a potential on the driver transistor side is as follows. In order to sufficiently decrease the ON resistance of the driver transistor 102, its size must be increased but is limited by the heater board design. For this reason, the ON resistance of the driver transistor 102 has a predetermined value, and it is often difficult to ignore the influence of variations in resistance value on measurement of variations in power generated by the heater. On the other hand, it is possible to suppress a resistance parasitic in the wiring resistance on the power supply terminal (VH) side by means of, e.g., increasing the film thickness of the wiring line.

In this case, a configuration capable of measuring the potential of a node between the heater 101 and the driver transistor 102 can measure a resistance component from which the ON resistance component of the transistor and the wiring resistance component on the power supply terminal (GNDH) side are removed. Thus, the tolerance of variations can be made wider than the conventional one, and the yield can be increased.

If the parasitic resistance 103 on the wiring side of the power supply terminal (VH) is much lower than the resistance of the heater 101, the ON resistance of the driver transistor 102, and the like, power measured from the voltage difference (VH-V2) between the power supply terminal (VH) 105 and the monitor terminal 116 and the current (I) flowing through the heater 101 can be substantially regarded as power generated by the heater. In this case, the configuration of the second embodiment can decrease the number of elements, compared to that in the first embodiment, and can achieve a higher yield while suppressing the layout area of the heater board.

The first and second embodiments have described a configuration capable of outputting potentials at the two ends of each of heaters at all bits shown in FIGS. 5 and 8. However, the present invention is not limited to output of potentials from all bits. For example, even when potentials are intermittently output at an interval of plural bits, the tolerance can be evaluated from variations in power generated by the heater that are obtained by measurement. Even in this case, the present invention is still effective.

In many cases, the characteristic does not steeply change between adjacent elements such as heaters or transistors which are arranged at high density by the semiconductor integrated circuit technique. Even when characteristics are selectively measured every several bits, variations in power generated by the heater on the heater board can be grasped while sufficient accuracy is maintained. The arrangement of switching elements for measurement at heaters requires a certain layout area. In order to suppress the area, switching elements are arranged at an interval of plural bits. With this arrangement, necessary measurement accuracy is still maintained, while an increase in layout area can be suppressed, compared to the first embodiment.

In the above embodiments, it is assumed that droplets discharged from the printhead are ink, and a liquid contained in the ink tank is ink. However, the content of the ink tank is not limited to ink. For example, the ink tank may contain a processing liquid which is discharged onto a printing medium in order to increase the fixing properties, water repellency, or quality of a printed image.

Of inkjet printing methods, the above embodiments adopt a method which uses means (e.g., an electrothermal transducer or laser beam) for generating thermal energy as energy utilized to discharge ink and changes the ink state by the thermal energy. This inkjet printing method can contribute to increasing the printing density and resolution.

The above embodiments have exemplified a serial scan type inkjet printing apparatus, but the present invention is not limited to this. The present invention can also be effectively applied to an inkjet printing apparatus using a full line type printhead having a length corresponding to the maximum width of a printable printing medium. The printhead of this type can employ a structure which satisfies the length by a combination of printheads, or an integrated printhead structure.

In addition, the present invention is also effective in a case where the serial scan type inkjet printing apparatus as described in the above embodiments uses a printhead which is fixed to the apparatus body, or an exchangeable cartridge type printhead which can be electrically connected to the apparatus body and receive ink from the apparatus body when attached to the apparatus body.

Furthermore, the inkjet printing apparatus according to the present invention may be used as an image output terminal for an information processing device such as a computer. The inkjet printing apparatus may also take the form of a copying machine combined with a reader, or a facsimile apparatus having a transmission/reception function.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-339443 filed on Nov. 24, 2004, the entire contents of which are incorporated herein by reference.

What is claimed is:

1. A head substrate having a plurality of printing elements and a plurality of driving elements for driving the plurality of printing elements comprising:

a first terminal, common to the plurality of printing elements, which receives a test signal for either one or more of the plurality of printing elements via a test select switch;

a second terminal which receives a selection signal for selecting and driving at least some of the plurality of printing elements; and a bit select switch for inputting the selection signal; and a third terminal which outputs a potential of one end of each of the printing elements selected by the selection signal received by said second terminal in response to the test signal received by said first terminal, said one end being connected to a corresponding one of the driving elements;

a fourth terminal which outputs a potential of the other end of each of the printing elements selected by the selection signal;

wherein the plurality of printing elements is connected to a common power supply terminal, and both ends of each of the plurality of printing elements are respectively connected to the third terminal and the fourth terminal via the test select switch and the bit select switch.

2. The head substrate according to claim 1, wherein the plurality of driving elements include first MOS transistors.

* * * * *